US008568562B2

(12) United States Patent
Sullivan et al.

(10) Patent No.: US 8,568,562 B2
(45) Date of Patent: Oct. 29, 2013

(54) CREPING METHODS USING PH-MODIFIED CREPING ADHESIVE COMPOSITIONS

(75) Inventors: Patrick Sullivan, Combined Locks, WI (US); Jack Allen, Memphis, TN (US)

(73) Assignee: Buckman Laboratories International, Inc., Memphis, TN (US)

( * ) Notice: Subject to any disclaimer, the term of this patent is extended or adjusted under 35 U.S.C. 154(b) by 0 days.

(21) Appl. No.: 13/558,459

(22) Filed: Jul. 26, 2012

(65) Prior Publication Data

US 2013/0032302 A1 Feb. 7, 2013

Related U.S. Application Data

(60) Provisional application No. 61/513,716, filed on Aug. 1, 2011.

(51) Int. Cl.
*B31F 1/12* (2006.01)

(52) U.S. Cl.
USPC ..... 162/112; 162/111; 162/158; 162/168.1; 162/181.1; 162/183; 156/183; 264/283

(58) Field of Classification Search
USPC ..... 162/111–113, 158, 14.1, 168.1, 162/181.1–181.5, 183, 135, 141, 204; 156/183; 264/282–284; 428/152–153
See application file for complete search history.

(56) References Cited

U.S. PATENT DOCUMENTS

| | | | |
|---|---|---|---|
| 2,926,116 | A | 2/1960 | Keim |
| 3,640,841 | A | 2/1972 | Winslow et al. |
| 3,879,257 | A | 4/1975 | Gentile et al. |
| 3,926,716 | A | 12/1975 | Bates |
| 4,063,995 | A | 12/1977 | Grossman |
| 4,300,981 | A | 11/1981 | Carstens |
| 4,304,625 | A | 12/1981 | Grube et al. |
| 4,501,640 | A | 2/1985 | Soerens |
| 4,528,316 | A | 7/1985 | Sorens |
| 4,684,439 | A | 8/1987 | Soerens |
| 4,707,520 | A | 11/1987 | Keogh |
| 4,788,243 | A | 11/1988 | Soerens |
| 4,837,272 | A | 6/1989 | Kelley |
| 4,883,564 | A | 11/1989 | Chen et al. |
| 4,886,579 | A | 12/1989 | Clark et al. |
| 4,994,146 | A | 2/1991 | Soerens |
| 5,025,046 | A | 6/1991 | Soerens |
| 5,179,150 | A | 1/1993 | Furman, Jr. et al. |

(Continued)

FOREIGN PATENT DOCUMENTS

WO 2010059699 A1 5/2010

OTHER PUBLICATIONS

International Search Report and Written Opinion issued in corresponding International Patent Application No. PCT/US2012/048231, dated Nov. 5, 2012 (10 pages).

*Primary Examiner* — Jose Fortuna
(74) *Attorney, Agent, or Firm* — Kilyk & Bowersox, P.L.L.C.

(57) ABSTRACT

A method for manufacturing a creped fiber web is provided and includes providing a rotating cylindrical dryer surface, providing a creping adhesive composition or coating package having a pH boosted at least 0.5 pH units relative to its original base formulation pH in the range of from about 4.5 to about 9, for chemically setting a crosslinkable polymer component at least in part before applying the creping adhesive composition to the rotating cylindrical dryer surface to provide an adhesive dryer surface on which a fiber web can be transferred, dried, and creped.

22 Claims, 3 Drawing Sheets

(56) References Cited

U.S. PATENT DOCUMENTS

| | | | | |
|---|---|---|---|---|
| 5,187,219 | A | | 2/1993 | Furman, Jr. |
| 5,234,547 | A | | 8/1993 | Knight et al. |
| 5,246,544 | A | | 9/1993 | Hollenberg et al. |
| 5,326,434 | A | | 7/1994 | Carevic et al. |
| 5,370,773 | A | | 12/1994 | Luu et al. |
| 5,374,334 | A | | 12/1994 | Sommese et al. |
| 5,382,323 | A | | 1/1995 | Furman, Jr. et al. |
| 5,437,766 | A | | 8/1995 | Van Phan et al. |
| 5,468,796 | A | | 11/1995 | Chen et al. |
| 5,487,813 | A | | 1/1996 | Vinson et al. |
| 5,490,903 | A | | 2/1996 | Chen et al. |
| 5,633,309 | A | | 5/1997 | Warchol et al. |
| 5,660,687 | A | | 8/1997 | Allen et al. |
| 5,833,806 | A | | 11/1998 | Allen et al. |
| 5,846,380 | A | | 12/1998 | Van Phan et al. |
| 5,902,862 | A | | 5/1999 | Allen |
| 5,942,085 | A | | 8/1999 | Neal et al. |
| 5,944,954 | A | | 8/1999 | Vinson et al. |
| 5,980,690 | A | * | 11/1999 | Warchol et al. ..... 162/111 |
| 5,981,645 | A | * | 11/1999 | Hollenberg et al. ..... 524/503 |
| 6,133,405 | A | | 10/2000 | Allen |
| 6,280,571 | B1 | | 8/2001 | Allen |
| 6,465,047 | B1 | | 10/2002 | Scott et al. |
| 6,663,942 | B1 | | 12/2003 | Luu et al. |
| 6,991,707 | B2 | | 1/2006 | Hill, Jr. et al. |
| 7,404,875 | B2 | * | 7/2008 | Clungeon et al. ..... 162/111 |
| 7,718,035 | B2 | | 5/2010 | Boettcher et al. |
| 7,943,705 | B2 | | 5/2011 | Allen |
| 2002/0096288 | A1 | * | 7/2002 | Allen ..... 162/168.1 |
| 2002/0173580 | A1 | * | 11/2002 | Allen ..... 524/503 |
| 2005/0006040 | A1 | * | 1/2005 | Boettcher et al. ..... 162/111 |
| 2005/0245669 | A1 | * | 11/2005 | Clungeon et al. ..... 524/515 |
| 2007/0151684 | A1 | * | 7/2007 | Grigoriev et al. ..... 162/111 |
| 2011/0218271 | A1 | * | 9/2011 | Boettcher et al. ..... 523/402 |
| 2011/0284176 | A1 | * | 11/2011 | Ringold et al. ..... 162/111 |
| 2012/0247697 | A1 | * | 10/2012 | Lu et al. ..... 162/111 |
| 2013/0032302 | A1 | * | 2/2013 | Sullivan et al. ..... 162/111 |

* cited by examiner

FIG. 3

| | | | Adhesive | | Mod | | | | | | |
|---|---|---|---|---|---|---|---|---|---|---|---|
| Time | Yankee | Reel | 5318 | mg | 2097 | mg | Pump | pH | psi | T Hoods | AD |
| 14:00 | 2588 | 2416 | 40 | 3.5 | 23 | 10.6 | | 8.1 | 108 | 720 | 19 |
| 15:00 | 2653 | 2477 | 40 | 3.4 | 23 | 10.4 | 18-20 | 8.1 | 108 | 800 | 19 |
| 15:30 | 2710 | 2530 | 40 | 3.3 | 23 | 10.1 | 20-20 | 7.8 | 108 | 800 | 19 |
| 16:00 | 2710 | 2530 | 40 | 3.3 | 23 | 10.1 | 20-20 | 7.94 | 108 | 840 | 24 |
| 16:20 | 2710 | 2530 | 40 | 3.3 | 23 | 10.1 | 20-20 | 8.01 | 108 | 840 | 19 |
| 17:30 | 2830 | 2642 | 40 | 3.19 | 23 | 9.72 | 20-20 | 8.14 | 118 | 888 | 39 |
| 18:00 | 2880 | 2717 | 40 | 3.14 | 23 | 9.55 | 20-20 | 7.8 | 110 | 840 | 40 |
| 18:05 | 2908 | 2716 | 40 | 3.11 | 23 | 9.45 | | | 110 | 840 | 39 |
| 18:15 | 2908 | 2716 | 40 | 3.11 | 23 | 9.45 | | 6.9 | 110 | 840 | 39 |

FIG. 4

| | 10% caustic | | | Adhesive | | Modifier | | | | | |
|---|---|---|---|---|---|---|---|---|---|---|---|
| Time | pH | Pump setting | temp C | H 5318 | mg | BSP 2097 | mg | mod/ adh | Yankee | Real | Crepe |
| 11:55 | 5.89 | | 56 | 75 | 3.05 | 73 | 15.68 | 5.1 | 4006 | 3559 | 11.2% |
| 12:02 | 6.05 | | 56 | 75 | 3.05 | 73 | 15.68 | 5.1 | 4006 | | |
| 12:07 | 6.25 | | 56 | 75 | 3.05 | 73 | 15.68 | 5.1 | 4006 | | |
| 12:17 | 7.19 | 50-35 | 56 | 75 | 3.05 | 73 | 15.68 | 5.1 | 4006 | | |
| 12:21 | 7.56 | 45-30 | 56 | 75 | 3.05 | 73 | 15.68 | 5.1 | 4006 | | |
| 12:23 | 7.74 | 35-20 | 56 | 75 | 3.05 | 73 | 15.68 | 5.1 | 4006 | | |
| 12:27 | 7.76 | 30-20 | 56 | 75 | 3.05 | 73 | 15.68 | 5.1 | 4006 | | |
| 12:30 | 7.75 | 30-20 | 56 | 75 | 3.05 | 73 | 15.68 | 5.1 | 4006 | | |
| 12:30 | 7.74 | 30-20 | 56 | 75 | 3.05 | 73 | 15.68 | 5.1 | 4006 | 3500 | 12.6% |
| 12:59 | 7.74 | 30-20 | 56 | 75 | 3.05 | 73 | 15.68 | 5.1 | 4006 | 3492 | 12.8% |
| 13:17 | 7.73 | 30-20 | 56 | 75 | 3.05 | 73 | 15.68 | 5.1 | 4006 | | |
| 15:00 | 7.68 | 30-20 | 56 | 75 | 3.05 | 73 | 15.68 | 5.1 | 4006 | 3531 | 11.9% |
| 15:10 | | 30-20 | 56 | 65 | 2.64 | 73 | 15.68 | 5.9 | 4006 | 3531 | 11.9% |
| 15:30 | 7.76 | 30-20 | 56 | 65 | 2.64 | 73 | 15.68 | 5.9 | 4006 | 3531 | 11.9% |
| 16:00 | 7.77 | 30-20 | 56 | 65 | 2.64 | 73 | 15.68 | 5.9 | 4006 | 3531 | 11.9% |
| | | 30-20 | 56 | 65 | 2.64 | 73 | 15.68 | 5.9 | 4006 | 3551 | 11.4% |
| 16:30 | 7.75 | 30-20 | 56 | 60 | 2.44 | 73 | 15.68 | 6.4 | 4006 | 3551 | 11.4% |
| 17:00 | 7.73 | 30-20 | 56 | 60 | 2.44 | 73 | 15.68 | 6.4 | 4006 | 3551 | 11.4% |
| 17:35 | 7.58 | 30-20 | 56 | 60 | 2.44 | 73 | 15.68 | 6.4 | 4006 | 3551 | 11.4% |
| 18:00 | 7.55 | 30-20 | 56 | 60 | 2.44 | 74 | 15.9 | 6.5 | 4006 | 3551 | 11.4% |

CREPING METHODS USING PH-MODIFIED CREPING ADHESIVE COMPOSITIONS

This application claims the benefit under 35 U.S.C. §119 (e) of prior U.S. Provisional Patent Application No. 61/513,716, filed Aug. 1, 2011, which is incorporated in its entirety by reference herein.

FIELD OF THE INVENTION

The present invention relates to the manufacture of crepe paper including soft, absorbent tissue paper webs and particularly to the mode of creping of such webs using pH modified creping adhesive compositions to attain adequate softness and adhesive characteristics in the web with enhanced creping performance.

BACKGROUND OF THE INVENTION

It is known in the art to form a thin paper web from a slurry of water and fiber, dewater the wet web, and then at least partially dry the dewatered web. In the manufacture of tissue and similar paper products, creping is commonly used on such dewatered webs to impart desirable properties, such as softness and bulk. Creping is typically accomplished by conveying or carrying the web on a fabric to a heated rotary drum termed in the art a Yankee dryer. The web commonly is transferred to an adhesive dryer surface of the dryer and carried around a major circumferential portion of the dryer before the web reaches a zone of web de-contact from the drum. The de-contact zone is equipped with a creping blade against which the web abuts so as to be pushed backwardly or compacted upon itself in a machine direction of the web and attain the well-known tissue crepe paper structure, at which point the resulting creped web is removed from the dryer and collected, usually in rolled up form.

Before the web is transferred to the Yankee dryer, typically an adhesive composition, sometimes referred to as a "coating package" in the industry, is applied directly to the dryer surface of the dryer to form the adhesive dryer surface. The creping action typically requires some adhesion of the web to the outer surface of the dryer to effect a consistent and uniform creping action. Creping adhesives alone or in combination with release agents or other adjuvants have been applied either to the web or to the surface of the dryer in efforts to provide some balance of adhesion and release between the web and the dryer surface for purposes of drying and creping.

Various properties of the creping adhesive can be factors in the creping performance obtained. The rewettability of the creping adhesive on the dryer surface can be one such factor. An adhesive which can rewet on the surface of the dryer may improve retention of the web on the dryer surface through creping and assist in reducing buildup on the drum and on the creping blade. Many conventional creping adhesives are not rewettable. Further, coating buildup can appear as a build-up of adhesive on the rear surface of the creping blade, such as along the edges or corners of the creping blade. This adhesive build up can cause chattering or bouncing of the blade. Eventually, portions of the web may skip underneath the creping blade, causing picks or holes in the removed creped web, which may lead to web breaks and machine downtime. The level of adhesion of the creping adhesive to the drum dryer surface can be another factor which affects creping performance and results. Inadequate adhesion can result in poor creping, sheet floating, poor sheet handling, or other problems, whereas excessive adhesion may result in crepe blade picking, web plugging behind the crepe blade, web breaks due to excessive tension, or other problems.

Various types of creping adhesives have been used to adhere fibrous webs to rotary dryers such as Yankee dryers. Creping adhesives have included, for example, polyvinyl acetate-ethylene copolymer emulsions and aqueous polyvinyl alcohol solutions. It has been found that conventionally used polyvinyl acetate-ethylene copolymer compositions, which may contain small percentages of polyvinyl alcohol such as less than about 5% of the total solids by weight, may be generally adequate for the purpose but can cause a number of undesirable effects, such as blocking problems and others as mentioned in U.S. Pat. No. 6,991,707 B2, which is incorporated herein by reference in its entirety. Polyvinyl alcohol compositions (which may contain some polyvinyl acetate) can pose similar problems when used as creping adhesives, and can tend to coat the dryer with a hard and uneven film that builds up as drying and creping proceed, resulting in uneven creping or other problems.

Other creping adhesives have included wet strength resins, such as polyamidoamines cross-linked with epihalohydrin (PAE). PAE resins are described, for example, in U.S. Pat. Nos. 2,926,116; 7,943,705 B2; and 7,718,035 B2. PAE resins are generally prepared by reacting an epichlorohydrin and a polyamide containing secondary or tertiary amine groups, followed by stabilizing the reaction products by acidification with sulfuric or hydrochloric acid. The creping adhesive desirably should be "rewettable," which is not a property of many conventional PAE resins as previously synthesized and used. A non-rewettable adhesive can result in buildup of adhesive on the dryer surface or cause other problems.

The present investigators have determined that creping performance and product quality in the manufacture of creped paper products can be enhanced by increasing the pH of settable or curable coating packages before application to a dryer surface.

SUMMARY OF THE INVENTION

A feature of this invention is to provide a method of enhancing creping performance by elevating the pH of a coating package before application to a dryer to form a coating film thereon.

Another feature of this invention is to provide a method of creping with elevating of the pH of a coating package prior to the application to a dryer surface to provide chemical setting of the coating package with thermal independence or at least reduced thermal dependence.

An additional feature of this invention is to provide a method of creping with upward-adjusting of the pH of a coating package prior to application of the coating package to a dryer surface to provide chemical set times which are capable of accommodating more challenging operational conditions, such as shortened dwell times, high running speeds, lowered dryer steam pressures, lightweight paper grades, smaller diameter Yankee dryers, or other more extreme operational conditions.

A further feature of this invention is to improve creping performance by elevating the pH of creping adhesive composition(s) at a mix pot and/or spray boom before application to a Yankee dryer.

Another feature of this invention is to provide a method of creping using a multifunctional setting agent which can elevate the pH of an adhesive creping formulation and provide a creping adhesive composition capable of reversible crosslinking and/or rewettable film formation.

An additional feature of this invention is to provide creped paper products of such methods.

Additional features and advantages of the present invention will be set forth in part in the description which follows, and in part will be apparent from the description, or may be learned by practice of the present invention. The objectives and other advantages of the present invention will be realized and obtained by means of the elements and combinations particularly pointed out in the written description and appended claims.

To achieve these and other advantages and in accordance with the purposes of the present invention, as embodied and broadly described herein, the present invention, in part, relates to a method for manufacturing a creped fiber web wherein the method includes providing a rotating cylindrical dryer which has a dryer surface, a coating applicator fluidly connected to a feed line (e.g., mixing vessel or supply) containing an adhesive base formulation which has a first pH of from about 3.5 to about 8.5 (or from about 4.5 to about 8.5) and comprises at least a crosslinkable polymer. A pH modifier is added to the adhesive base formulation to provide a creping adhesive composition which has a second pH value that is at least about 0.5 pH units greater than the first pH value. After pH modification (or even during pH modification), the creping adhesive composition is applied to the dryer surface with the coating applicator to provide an adhesive dryer surface. A fibrous web is conveyed into contact with the adhesive dryer surface, the fiber web is dried on the adhesive dryer surface to form a dried fiber web, and the dried fiber web is creped and removed from the adhesive dryer surface. As an option, the pH of the adhesive base formulation can be upward adjusted up to pH about 9.0 before coated on the Yankee dryer. As another option, the original pH of the adhesive base formulation can be acidic. The crosslinkable polymer can be, for example, a crosslinkable cationic water-soluble polymer which can be rewettable on the dryer surface. The adhesive base formulation can further combine the crosslinkable polymer with one or more of a release modifier (e.g., oil based or aqueous based), a phosphate donor, a different polymer, or other additives, or any combinations of these. As an option, a multifunctional setting agent can be used which elevates the pH of an adhesive creping formulation and provides a creping adhesive composition capable of reversible crosslinking, which can improve the set time and rewettability of the adhesive film.

The present invention further relates to creped fiber products made from the indicated method.

As used herein, "setting" refers to a crosslinking reaction which includes a crosslinkable polymer to form a crosslinked or thermoset polymer material.

As used herein, "chemically setting" refers to a chemical reaction of at least one crosslinkable polymer and a setting agent which forms a crosslinked or thermoset polymer material. Heating is not a required part of this definition, although system heat, whether ambient or actively provided, may contribute in some part, or not at all, to the overall setting process.

The term "rewettable" or "rewetting" and similar variants refers to the capability of a polymer to change from a crosslinked or chemically set state to a tacky condition.

As used herein, the "coating package" refers to the complete coating formulation which is applied to the dryer surface of the rotary dryer. As used herein, a "base formulation" can be supplemented with a pH modifier to provide a coating package of the present invention. As used herein, a "base formulation" is a chronological characterization of an adhesive formulation, which can be supplemented with different components before use, such as the indicated pH modifier.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

It is to be understood that both the foregoing general description and the following detailed description are exemplary only and are not restrictive of the present invention, as claimed. All patents, patent applications, and publications mentioned above and throughout the present application are incorporated in their entirety by reference herein.

The accompanying drawings, which are incorporated in and constitute a part of this application, illustrate some of the features of the present invention and together with the description, serve to explain the principles of the present invention.

BRIEF DESCRIPTION OF THE DRAWINGS

The present invention may be more fully understood with reference to the accompanying figures. The figures are intended to illustrate exemplary features of the present invention without limiting the scope of the invention.

FIG. 3 is a table showing various testing parameters for a creping operation using a creping adhesive composition which is pH modified according to a method of the present invention (Example 1).

FIG. 4 is a table showing various testing parameters for a creping operation using a creping adhesive composition which is pH modified according to a method of the present invention (Example 2).

DETAILED DESCRIPTION OF THE PRESENT INVENTION

Figure 1:
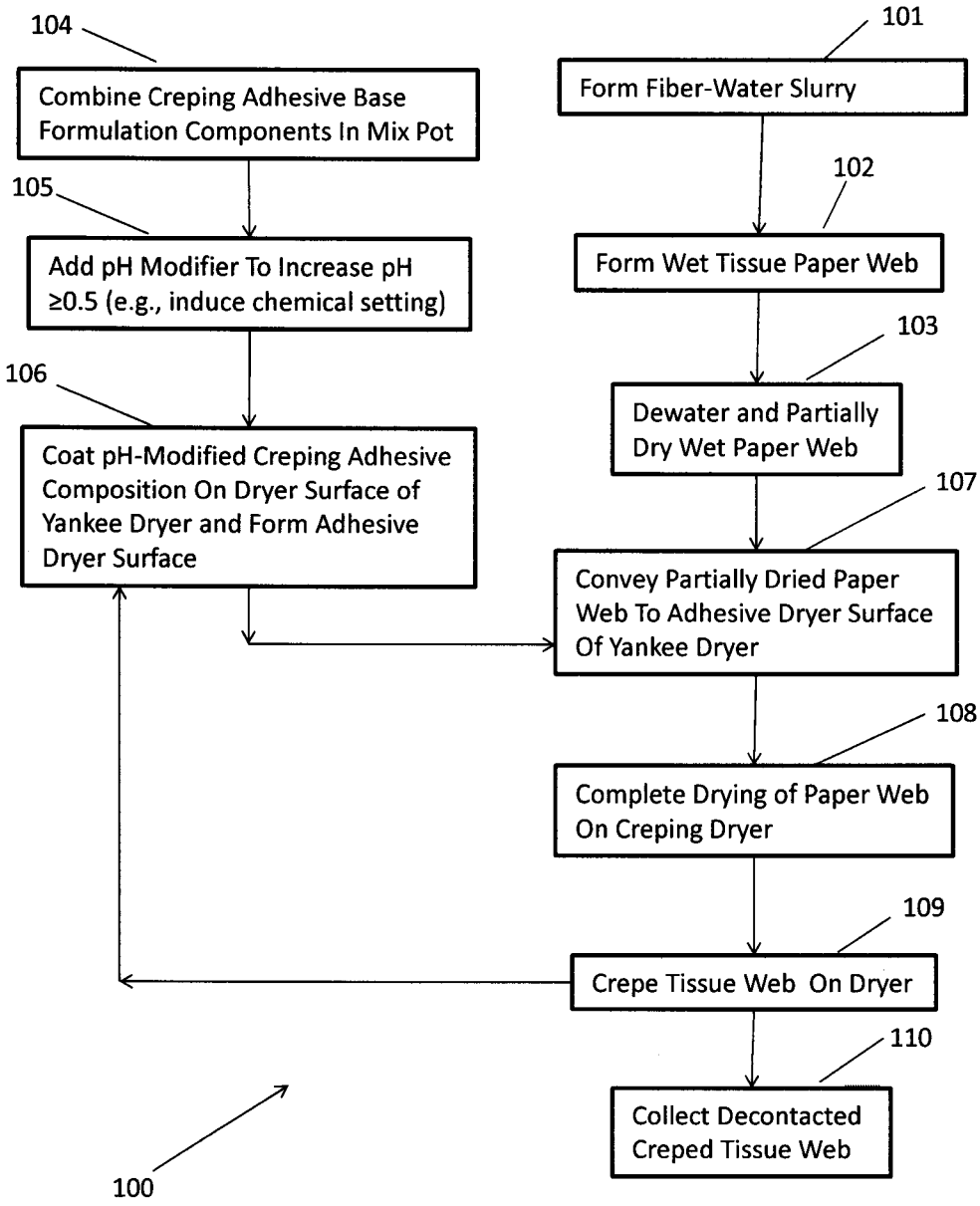
FIG. 1 is a flow chart illustrating a process according to the present invention.

According to the present invention, a method of manufacturing crepe paper, including soft, absorbent tissue paper webs, and particularly to modes of creping of such webs using pH modifications of creping adhesives are provided with improved creping performance while minimizing operational difficulties and accommodating a wide range of operating conditions. Enhanced creping performance can be achieved by elevating the pH of an adhesive base formulation (having an original pH of from about 3.5 to about 8.5, or from about 4.5 to about 8.5) by at least about 0.5 pH units before coated on a rotary dryer with the resulting composition. The pH modification can initiate setting (crosslinking) or speed up the setting of at least one crosslinkable adhesive component of the coating package prior to establishing contact with the Yankee surface or other dryer surface. These enhancements may take the form, for example, of thicker coating film development with faster setting rates and coating film development on the dryer along with reduced streaking, chatter, and/or corrugation, as compared to the performance of the original unmodified adhesive composition (i.e., without the pH elevation adjustment). Higher visual coating development, for example, can be achieved, even at reduced add-on rates.

Further, as an option, the coating package can be set chemically, at least in part, or primarily, or completely, instead of thermally set. A chemically-set creping adhesive composition or coating package can be provided by driving cross-linking of at least one crosslinkable polymer component of the adhesive base formulation by increased pH. Elevating the pH of an adhesive base formulation before reaching and/or in a coating applicator, such as a spray boom of a Yankee dryer, can facilitate the setting rate of the coating package independent of any thermal treatment or activation applied to the coating package. The method can reduce or eliminate thermal setting requirements for the coating package. Even though chemical setting is initiated by the indicated pH modification before the adhesive composition is coated on the dryer, it can remain coatable with a sprayer or other coating device. The change in pH provided in the methods of the present invention can accelerate film formation on the dryer. This effect of accelerating the setting of the adhesive by a chemical treatment can be especially useful for Yankee dryers, such as small diameter Yankee dryers, operated with short dwell times (e.g., from coating application to suction press roll (SPR) nip), low steam pressures, high running speeds, lightweight paper grades (e.g., 8.8#), and other more extreme operating conditions.

The setting rate provided in the creping adhesive composition by addition of the pH modifier in methods of the present invention can be a direct positive function of the amount of pH increase imparted. For example, greater imparted pH increases can yield corresponding faster setting rates. Using a higher pH creping adhesive composition in a spray boom or other coating applicator can reduce corrosion on equipment coming into contact with the creping adhesive composition. The level of pH increase imparted can be controlled to adjust the window of the set point of the coatings to balance setting and tack properties of the coated film. The level of pH increase imparted can be increased until sheet float is encountered. The pH of the adhesive base formulation can be upward adjusted up to about 9.0 before coated on the Yankee dryer.

As another option, the inducement of setting by the pH modification as indicated can provide a creping adhesive composition capable of reversible crosslinking. This property can improve the set time and rewettability of the adhesive film. By elevating the pH, visibly better coating build-up and reduced release aid requirements can be provided. The methods of the present invention can provide the creping operator with additional tools and options to control the coating package. The resulting creping adhesive compositions may form thickened coating films on the dryer surface with suitable adhesion properties for creping.

For purposes of the present invention, the pH modification of the present invention can occur at any location (or multiple locations) up to where the adhesive base formulation is applied to the dryer surface. The adhesive base formulation prior to pH modification as described herein can be fed to the coating applicator(s) from a supply or feed (e.g., one or more feed lines (once through feed lines or closed loops systems), mixing pot, mixing vessel, supply tank, and the like). The pH modification can even occur at the time of contacting the dryer surface. The pH modification can be accomplished on a continuous, semi-continuous, or as batches. The pH modification can be done to form a pre-mixture that is added to the dryer surface. The pH modification can be done through a feed line where the pH modifier is added to the adhesive base formulation through a feed line or drip line or any feed to achieve the desired pH modification described herein. The pH modification of the present invention to form the creping adhesive composition of the present invention can be achieved in a mixing vessel, mixing pot, in the make up water, in the feed to the spray boom, in the return to a mixing tank. The present invention can be used in a once through system and/or a closed-loop system. The present invention can be used in a pressurized system, such as a pressurized closed loop system.

After the indicated pH modification, the resulting creping adhesive composition can be coated onto a dryer surface to form an adhesive dryer surface and combined with a partially dewatered paper web for creping. A partially dewatered paper web can be transferred to the adhesive dryer surface, for example, and then can be carried on the rotating dryer for further dewatering until reaching a creping blade or other creping device. The creping device crepes the web, and the resulting creped web is removed from the dryer and collected, such as on a reel. After removal of the creped web, the dryer surface optionally can be cleaned, and then can be rotated back to the adhesive coating zone, and the indicated process cycle can be repeated as part of a continuous or semi-continuous running mode. As stated, a feature of the method of the present invention is the pH modification of an adhesive base formulation before coating on the dryer. The components of the adhesive base formulation can be combined in a mix pot or other suitable mixing vessel to provide a base formulation which can rapidly reach a steady-state pH value before addition of the pH modifier in the range of from about 3.5 to about 8.5 or from about 4.5 to about 8.5, or from about 5 to about 8 or from about 5.5 to about 8, or from about 4.5 to about 6, or from about 4 to about 7. As another option, the original pH of the adhesive base formulation can be acidic (i.e., <pH 7.0), and the pH can be upward adjusted up to about 9.0. As used herein with respect to pH value, "steady-state pH value" refers to a value which can have ±0.25 tolerance when successively measured the same way. If slight variations in pH values within the indicated tolerance are measured for the adhesive base formulation before addition of the pH modifier, the largest measured pH value is used as the reference point for calculating the adjusted pH value which will have at least a 0.5 pH unit increase provided by adding the pH modifier. As an option, the pH modifier can be added to the adhesive base formulation in an amount which increases the pH of the resulting creping adhesive composition as compared to the original pH of the adhesive base formulation at least about 0.5 pH units, or at least about 0.6 pH units, or at least about 0.7 pH units, or at least about 0.8 pH units, or at least about 0.9 pH units, or at least about 1.0 pH units, or at least about 1.5 pH units, or at least about 2.0 pH units, or at least about 2.5 pH units, or at least about 3.0 pH units, or from about 0.5 to about 3.0 pH units, or from about 0.6 to about 2.5 pH units, or from about 0.7 to about 2.0 pH units, or from about 0.8 to about 1.5 pH units, or from about 0.9 to about 4.0 pH units, or other ≥0.5 pH unit increases relative to the pH of the adhesive base formulation. The pH values of adhesive base formulation and creping adhesive composition are based on at least one pH measurement taken from the respective composition, or an extracted sample thereof, after all of the components of the respective formulation or composition have been combined and stirred or otherwise agitated to provide a substantially uniform mixture of the components added to that point and a steady-state pH value is provided. A conventional submersible pH probe, or other suitable submersible pH measuring device, which can support real time measurements and display of results, can be used.

When upward adjusted at least about 0.5 pH units, the resulting creping adhesive composition from the pH modification can be rapidly settable while still being coatable via a spray boom or other applicator to a dryer surface. The chemical setting of the creping adhesive which is provided in the present method with the pH adjustments can permit the Yankee dryer to be operated at lower temperature with less energy requirements and less dependence on temperature control. For example, the crosslinkable polymer in the adhesive base formulation can be crosslinked with less dependence on or independence from temperature settings or adjustments (e.g., heating) made to the composition on or off the Yankee drum. Requirements for thermal activation of the adhesive on the dryer surface can be reduced in the methods of the present invention. This can permit reduced heating requirements at the dryer, increased run speeds of the web and dryer, shorter web dwell times on the dryer, or combinations of these advantages.

The indicated pH modification can provide improvements in creping performance and product quality as compared to use of the adhesive base formulation without the indicated pH modification. For example, coatings with thickened development or continuous development at reduced add-on, less streaks, reduced chatter, reduced corrugation, or combinations of these advantages on the Yankee dryer can be provided. Further, the method can provide creping adhesive compositions which are rewettable to enhance creping quality and performance. A rewettable adhesive can be capable of being activated (rewetted) on the dryer surface, for example, when a pressure roller brings the paper web into initial contact with the adhesive on the dryer surface. This activation can occur in part, for example, from the chemical structure of the adhesive, additives used, the moisture content in the web, or combinations of these or other reasons. Rewettability also may affect adhesiveness, particularly as the moisture content in the web decreases, such as in higher fiber-consistency (lower moisture content) webs. The methods of the present invention also may assist in controlling wear, corrosion, or both, on the Yankee dryer and creping blade surfaces, which, if achieved, can reduce equipment maintenance requirements and production downtimes.

Although this application illustrates the method with reference generally to a tissue paper at instances, it will be appreciated that the invention can be used for manufacture of a wide variety of creped paper products, such as bath tissue, paper towels, facial tissue, paper napkins, filter papers, coffee filters, sanitary napkin wrappers, and other creped paper products. The creped paper products can be single-ply or multi-ply products.

Referring now to the drawings, FIG. 1 is a flow chart showing a series of steps included in a method according to the present invention that can be used for the formation of a creped tissue paper web (process 100). Such webs can have a finished basis weight, for example, in the range of from about 1 to about 80 pounds per 3,000 square feet, or from about 7 to about 40 pounds per 3,000 square feet, or other basis weights, and can be formed from aqueous fiber slurries. According to the present invention, in steps 101-102, a thin paper web can be formed from a slurry of water and fiber using a conventional web forming technique or other suitable method, and then in step 103, the web can be dewatered at least in part, such as at least partially dried. For example, the slurry can be directed to a conventional Fourdrinier drainage wire to form a fiber web. Dewatering of the fiber web can occur through the wire in a conventional manner. The fibrous web can be formed of various types of wood pulp based fibers which are used to make the above products, such as hardwood kraft fibers, softwood kraft fibers, hardwood sulfite fibers, softwood sulfite fibers, chemi-thermo-mechanical fibers, thermomechanical pulps, refiner mechanical pulps, recycled paper fibers, or other pulp fibers, or any combinations thereof. As an option, before transfer to the Yankee dryer or other rotary dryer, the fiber web can be dried to a fiber consistency of from about 10% by weight to about 90% by weight, or from about 20% by weight to about 80% by weight, or from about 25% by weight to about 75% by weight, or from about 40% by weight to about 60% by weight, or from 40% by weight to about 50% by weight, or other values, before being conveyed to the web dryer surface. For purposes herein, "fiber consistency" refers to the percentage value of dry fiber weight relative to the total weight of the web. As an option, the "moisture content" of the web may constitute most or all of the balance of the web weight. For example, the fibrous web, prior to application to the Yankee dryer or other rotary dryer, can have moisture contents, for example, of from about 90% by weight to about 10% by weight, or from about 75% to about 25% by weight to about 75% by weight, or from about 60% by weight to about 40% by weight, or from about 50% to about 60% by weight, or other values, can be processed according to the methods of the present invention. Such webs accordingly would have fiber contents making up the additional weight % of the web. After dewatering, the web can then be conveyed, e.g., carried on a fabric, to a creping dryer or web dryer, which can be, for example, a steam-heated rotary drum dryer, referred to herein and elsewhere as a Yankee dryer. Before receiving the fiber web, an adhesive dryer surface of the Yankee dryer is prepared in a unique manner as part of the present method, which can involve steps 104-106 in this illustration.

In step 104 shown in FIG. 1, creping adhesive base formulation components are fed, recirculated, or both into a mixing pot or other suitable mixing vessel, which can be equipped for agitation of its contents. Although not shown, the creping adhesive base formulation components can be fed into a closed loop system, such as a pressurized closed loop system, or can be fed into a once through application system. As an option, the creping adhesive composition can be prepared as an aqueous film-forming dispersion of the active components including a crosslinkable polymer, a pH modifier, and any other additives. As an option, the crosslinkable polymers are sourced as acidic compositions (e.g., pHs from about 3.5 to about 6.0 or higher, or from about 4.5 to about 5.5, or from about 4.5 to about 5.0, or other acidic pH values). In step 105, a pH modifier is added of a type and amount effective to increase the pH of the contents at least 0.5 pH units (e.g., increased to a pH of 4 or higher, such as a pH of 4.5 or 5.0 or higher, such as or 6.0, or 7.0, or 8.0, or higher values up to pH about 9.0, or other ≥0.5 increases between pH 5-9). In step, 106, the resulting creping adhesive composition is coated on a dryer surface of a Yankee dryer or other large rotary dryer, and an adhesive dryer surface is formed. As an option, creping adhesive compositions can be applied to the Yankee surface as the sole active agent, or optionally with a release aid, and further optionally with a phosphate donor or other additives and resins, through the same spray boom or other coating applicator. As an option, creping adhesives alone or in combination with release agents can be applied to the surface of the dryer in order to provide the appropriate adhesion to produce the desired crepe. As generally understood, the adhesive portion and any release aids used in the coating composition may migrate differentially as between a hot Yankee surface and the opposite web surface. Adhesion modifiers, if used, may assist in controlling the adhesion force to assist crepe within a broader range of moisture operation. As an option, the spray boom or other coating applicator can be located after the creping blade and any cleaning blade, but before the pressure roll, using specific geometries and spray pressures to achieve desired results.

In step 107 shown in FIG. 1, the dewatered and partially dried wet paper web is conveyed, for example, carried on a fabric, to the adhesive dryer surface of a large rotary dryer, such as a steam-heated and/or hood heated rotary drum dryer, referred to herein and elsewhere as the Yankee dryer. A Yankee dryer can be a large diameter, typically about 8 to about 20 foot diameter drum, or other diameters, which is designed to be pressurized with steam to provide a hot surface for completing the drying of papermaking webs at the end of the papermaking process. The web can be transferred to the dryer, for example, at a circumferential dryer position, such as a position at least about halfway around, or at least about 75% around, the cylindrical dryer with respect to the zone of web de-contact where the creped web is separated and removed from the drum. The transfer fabric can be, for example, a transfer and impression fabric having knuckles which can compact a portion, e.g., about 20% or other amounts, of the surface of the web on a creping or Yankee dryer, to form a knuckled fiber web. As an option, the creping adhesive composition can retain the knuckled fiber web on the web dryer surface until a fiber consistency of the web is about 75% by weight or more, for example, at least about 95% by weight. In some modes of operation referred to herein as through-air drying, contact of the web with the dryer surface is limited. Methods and systems of through-drying operations which optionally may be used in the present invention include those such as described in U.S. Pat. No. 6,991,707 B2, which is incorporated herein by reference. The methods of the present invention can be used, for example, with through-air drying systems with creping methods, with Yankee dryer systems and methods, and with wet-crepe machines, systems, and methods. In step 108, the web can be retained on the adhesive dryer surface while carried around or on the dryer until reaching a de-contact zone. In step 109, the de-contact zone can be equipped with a creping device, such as a creping blade or doctor blade, against which the web abuts so as to be pushed or compacted backwardly upon itself and attain a recognizable tissue crepe paper structure. In step 110, the creped web can be recovered off the dryer. The web can be creped from the dryer to form a dried web having a fiber content or consistency, for example, of about 75% by weight or higher, for example, at least about 90% by weight, or at least about 95% by weight, or at least about 97% by weight consistency, and then can be wound into rolls or otherwise be collected off the dryer. At the creping stage, the fibrous web can have a water content, for example, of less than 25% by weight, or less than about 10% by weight, or less than about 7% by weight, or less than about 5% by weight, or other amounts.

The creping adhesive compositions or coating packages used in methods according to the present invention include at least one crosslinkable polymer. The polymer can be partially crosslinked, but not completely cross-linked, wherein it can have some crosslinkability still available when added to the adhesive base formulation. The crosslinkable polymer can be, for example, a self-crosslinkable polymer used alone, or a crosslinkable polymer used in combination with one or more different crosslinkable or non-crosslinkable polymers. The crosslinkable polymer can be rewettable. As an option, the crosslinkable polymer can be any polymer which can form a continuous or substantially continuous film when dried from an aqueous solution on a dryer surface of a Yankee dryer.

Crosslinkable polymers useful in the present invention can include, for example, crosslinkable natural polymers, crosslinkable synthetic polymers, crosslinkable thermoplastic polymers, thermosetting polymers, or any combinations thereof. The crosslinkable polymers can be, for example, homopolymers, copolymers, block copolymers, multi-stage polymers, star polymers, or any combinations thereof. Non-limiting examples of polymer chemistries include, but are not limited to, ethylene vinyl acetate polymers, acrylic homopolymers and copolymers, vinyl acetate homopolymers, polyamides, polyvinyl alcohols, starches, cellulosics, poly(aminoamide)-epichlorohydrins (PAEs), ionene polymers, polymeric quaternary ammonium compounds (polyquats), or other polymers, or any combinations thereof. The polymer can be functionalized to provide crosslinking functionality. Other crosslinkable polymers which may be used include those mentioned, for example, in U.S. Pat. No. 5,246,544, which is incorporated herein by reference in its entirety.

The crosslinkable polymer can be, for example, a crosslinkable cationic water-soluble polymer. Polymers which can be used include, for example, BUBOND® series release agents, such as BUBOND® 2062, BUBOND® 2624, sold by Buckman Laboratories International Inc., Memphis, Tenn. USA. Crosslinkable or partially crosslinked, partially crosslinkable PAE type resins may be used. PAE resins synthesized with a small excess of epihalohydrin with the extent of crosslinking controlled to terminate by the addition of acid before reaching completion can be used, such as mentioned in U.S. Pat. No. 7,718,035 B2, which is incorporated herein by reference in its entirety. CREPETROL® 5318, for example, a commercial PAE creping adhesive sold by Hercules Incorporated, can be used. Partially or lightly crosslinked ionene polymers or polymeric quaternary ammonium compounds (polyquats) may be used, such as mentioned in U.S. Pat. No. 6,991,707 B2, which is incorporated herein by reference in its entirety.

A second or more optional polymer which can be used with the crosslinkable polymer can be, for example, a wet strength or hard cationic resin or polymer that is non-crosslinkable or crosslinkable. Another type of optional polymer which may be used can be a soft polymer which has a lot of tack, which may assist edge control at high running speeds. A non-limiting commercial example of such a soft, yet tacky resin is PROSOFT® TC9700, an EPI-crosslinked poly(aminoamide), sold by Hercules Incorporated. Other optional polymers which may be used include, for example, CREPETROL® 1145, or any other crosslinking adhesive of a pH below 5.

The crosslinkable polymer concentration in the creping adhesive composition can depend in part on the coating process used to apply the coating on a dryer surface. In spray boom applications, the total crosslinkable polymer solids of the creping adhesive composition can range, for example, from about 0.05% by weight to about 20% by weight, or from about 0.1% by weight to about 15% by weight, or from about 0.5% by weight to about 12% by weight, or from about 0.75% by weight to about 10% by weight, or from about 1% by weight to about 7% by weight, or from about 1.5% by weight to about 5% by weight, based on the total weight of a sprayable composition (solids and liquids). As an option, the sprayable creping adhesive composition can comprise the crosslinkable polymer in a concentration of from about 1% by weight to about 99% by weight, or from about 3% by weight to about 95% by weight, or from about 4% by weight to about 75% by weight, or from about 5% by weight to about 50% by weight, or from about 7% by weight to about 30% by weight, based on total dry solids weight of the creping adhesive composition.

Examples of pH modifiers that can be used to elevate the pH of the adhesive base formulation include, for example, caustic materials, alkali materials (e.g., alkali metal materials, alkaline earth metal materials), and basic buffering materials, or any combinations thereof. The pH modifier can be inorganic or organic, or combinations and mixtures of these different types of pH-modifying materials. The pH modifier can be, for example, an alkali metal hydroxide, an alkali metal oxide, an alkali metal phosphate, an alkali metal carbonate, an alkali metal bicarbonate, an alkaline earth hydroxide, an alkaline earth oxide, an alkaline earth phosphate, an alkaline earth carbonate, ammonium zirconium carbonate, organotitanate, organozirconate, ammonium hydroxide, ammonium carbonate, ammonium bicarbonate, alkali metal silicate, urea, substituted urea, a cyanate, an alkylamine, an alkanolamine, a quaternary ammonium salt, a salt of a weak acid and a strong base, an alkaline buffering solution, polyalkali metal pyrophosphates, or any combinations thereof. An example of an alkali metal hydroxide which may be used is NaOH. Example of alkaline earth metal hydroxide which may be used, for example, are $Mg(OH)_2$, $Ca(OH)_2$, or any combinations thereof. The alkali salts can be used as brines or in water-soluble salt forms. As an option, an alkaline buffering agent can be used in the adhesive base formulation to establish alkalinity and resist pH changes. Examples of alkaline buffers which can be used include, for example, magnesium oxide, and an aqueous solution of disodium phosphate and monosodium phosphate. Examples of alkanolamines include triethanolamine, diethanolamine, or monoethanolamine. The pH modifier can be, for example, an Arrhenius base (i.e., a substance that ionizes in water to produce hydroxide ions), a Brønsted-Lowry base (i.e., a substance that can accept a proton or hydrogen cation ($H^+$)), or a Lewis base (i.e., a species that donates an electron pair), provided its introduction can affect an increase in the pH of an adhesive base formulation. The dosage rate of the pH modifier depends on factors of the level of pH increase sought, the base strength of the particular material, and the addition rate. As a non-limiting example, to increase the pH about 0.5 units, a 10% by weight NaOH solution can be added in a wt:wt ratio (solids only basis) to crosslinkable polymer having an original pH in water of about 4.0 to about 6.0 in a range amount of about 1/30 to about 30/1, such as 1/10 or 10/1, or other range values. The magnitude of further increases in pH obtained by further increasing the amount of pH modifier added may be approximately proportional or at least may trend together.

As an option, a multi-functional agent can be used which increases the pH of the adhesive base formulation and performs at least one different function when used in the adhesive base formulation. The different function, for example, can be a processing aid function or a performance agent function. For example, a multi-functional setting agent can be used which increases the pH of the adhesive base formulation and structurally participates in the crosslinking of the crosslinkable polymer. Multi-functional crosslinking materials of this type can include, for example, ammonium zirconium carbonate, organotitanates, organozirconates, or like materials. Additional multi-functional setting agents which can be used in methods of the present invention are described, for example, in U.S. Pat. Nos. 4,837,272 and 6,663,942 B1, which are incorporated herein by reference in their entireties.

As an option, a polyalkali metal pyrophosphate can be added to the adhesive base formulation to increase the pH of the resulting creping adhesive composition, which additionally can provide at least one other function, such as reducing or eliminating coating streaks, minimizing corrugation on the creping drum/rolls, or providing combinations of these or other affects, in the manufacture of creped fiber web in a process of the present invention. For example, a polyalkali metal pyrophosphate can be used to increase the pH of an adhesive base formulation which has an original pH value in the range of about 4.5 to about 8.5, such as an original acidic value (pH<7.0, e.g., pH about 3-4), at least 0.5 pH units, and to reduce coating streaks and/or minimize corrugation in providing a creping adhesive composition suitable for use in the process of the present invention. The polyalkali metal pyrophosphate can be, for example, tetrapotassium pyrophosphate, tetrasodium pyrophosphate, or salts thereof, or any combinations thereof. A polyalkali metal pyrophosphate in an aqueous form can be used for the addition or combination with an adhesive base formulation as described herein. For example, a tetrapotassium pyrophosphate (TKPP) salt (e.g., CAS No. 7320-34-5) in water can be used (e.g., CAS No. 7732-18-5). As another example, tetrasodium pyrophosphate (TSPP) salt (e.g., CAS No. 7722-88-5) in water can be used. For example, about 50 wt % to about 70 wt % TKPP singly, TSPP singly, or combinations thereof, in water or other concentrations can be used as a multi-functional agent in combination with an adhesive base formulation that is used in a process of the present invention. A commercial product which contains TKPP, which can be used as such a multi-functional agent in a process of the present invention, is BUSPERSE® 2436, sold by Buckman Laboratories International Inc., Memphis, Tenn. USA. The higher the dosage of polyalkali metal pyrophosphate added to an adhesive base formulation on an application rate basis (e.g., $mg/m^2$) in a process of the present invention, the greater the increased pH adjustment in the resulting creping adhesive composition that can be provided. The higher the dosage of polyalkali metal pyrophosphate added to the adhesive base formulation, the less the coating streaks that tend to build up when using the resulting creping adhesive composition on a creping roll or drum. Similarly, the extent of corrugation in the creped fiber web can be further minimized by increasing the dosage of the polyalkali metal pyrophosphate added to the adhesive base formulation. The use of polyalkali metal pyrophosphate as a multi-functional pH modifier also can allow for the use of reduced dosage of the crosslinkable polymer in the adhesive base formulation on an application rate basis ($mg/m^2$), and allow the sheet quality to be maintained by controlling the set point of the adhesive for optimal tackiness. An upper limit on the dosage of the polyalkali metal pyrophosphate used in the creping adhesive composition may be reached if the crosslinkable polymer reacts too rapidly, which may make it difficult to pick up the sheet at the pressure roll and result in severe corrugation.

In addition to the indicated pH modifier, the creping adhesive composition comprising the crosslinkable polymer can comprise one or more release agents, as well as other additives that may affect the creping process. Suitable creping release agents are, for example, described in U.S. Pat. Nos. 5,660,687 and 5,833,806, incorporated herein by reference in their entireties. Other release agents which can be used include, for example, BUSPERSE® series release agents, such as BUSPERSE® 2097, BUSPERSE® 2906, which are sold by Buckman Laboratories International Inc., Memphis, Tenn. USA. The creping action can be facilitated by ensuring that the web is adhered to the dryer to effect a consistent and uniform creping action, and for example, to prevent flaring of the web from the dryer before or at the exit zone in the vicinity of the creping blade. The tightness of the adhesion of the web to the dryer optionally can be controlled (e.g., reduced) by using a release agent, such as silicone oil, other oils, surfactants, soaps, shampoos, or conventional additives for creping adhesives or other adhesives. A release agent, if used to limit adhesion, can either be applied between the surface of at least one of the dryer and the web, mixed with the adhesive base formulation, or combinations of these. Other processing aids which can be used include, for example, BUSPERSE® 2906, which is sold by Buckman Laboratories International Inc., Memphis, Tenn. USA. BUSPERSE® 2906, for example, can help to control coating build-up at the cleaning blade and can also slow down coating streak build-up. The additives can be used in amounts effective for providing the indicated or other effects. The indicated polyalkali metal pyrophosphates, such as BUSPERSE® 2436, also may be used as an additive that is included in the creping adhesive composition in an amount which does not necessarily cause a pH increase of at least about 0.5 pH, but is sufficient to impart other desired processing or performance aids or benefits.

In addition to the adhesive components and release agent additives, creping adhesive formulations can further comprise surfactants, dispersants, salts to adjust the water hardness, modifiers, anti-corrosion agents, fillers, opacity agents, whiteners, crosslinking agents, or other useful additives. By including a small amount of monoammonium phosphate (MAP), for example, the adhesive formulation can minimize corrosion that may otherwise be caused by chlorides in or from any ionene or other chlorine-containing polymer(s), if used. Other Yankee cylinder protection/corrosion inhibition agents which may be used include, for example, BUTROL® series agents, sold by Buckman Laboratories International Inc., Memphis, Tenn. USA. Suitable additional modifiers include, but are not limited to, tackifier resins of U.S. Pat. No. 6,133,405, or the stabilizers of the U.S. Pat. No. 6,280,571, which are incorporated herein by reference in their entireties. A crosslinking agent or catalyst can be included in the adhesive base formulation, which can promote crosslinking, depending on the type of polymer used and the crosslinking agent.

Application of the creping adhesive compositions to a dryer surface of a Yankee dryer or other rotary dryer can be done in any manner known in the art and in forms comprising aqueous, solid, dispersion, or aerosol. As stated, a preferred option of application is via a spray boom directed at the surface of the drying surface prior to transfer of the paper web. Spray application of the creping adhesive composition can be done according to any of the conventional methods known in the art or any desired combination of application procedures.

Figure 2:
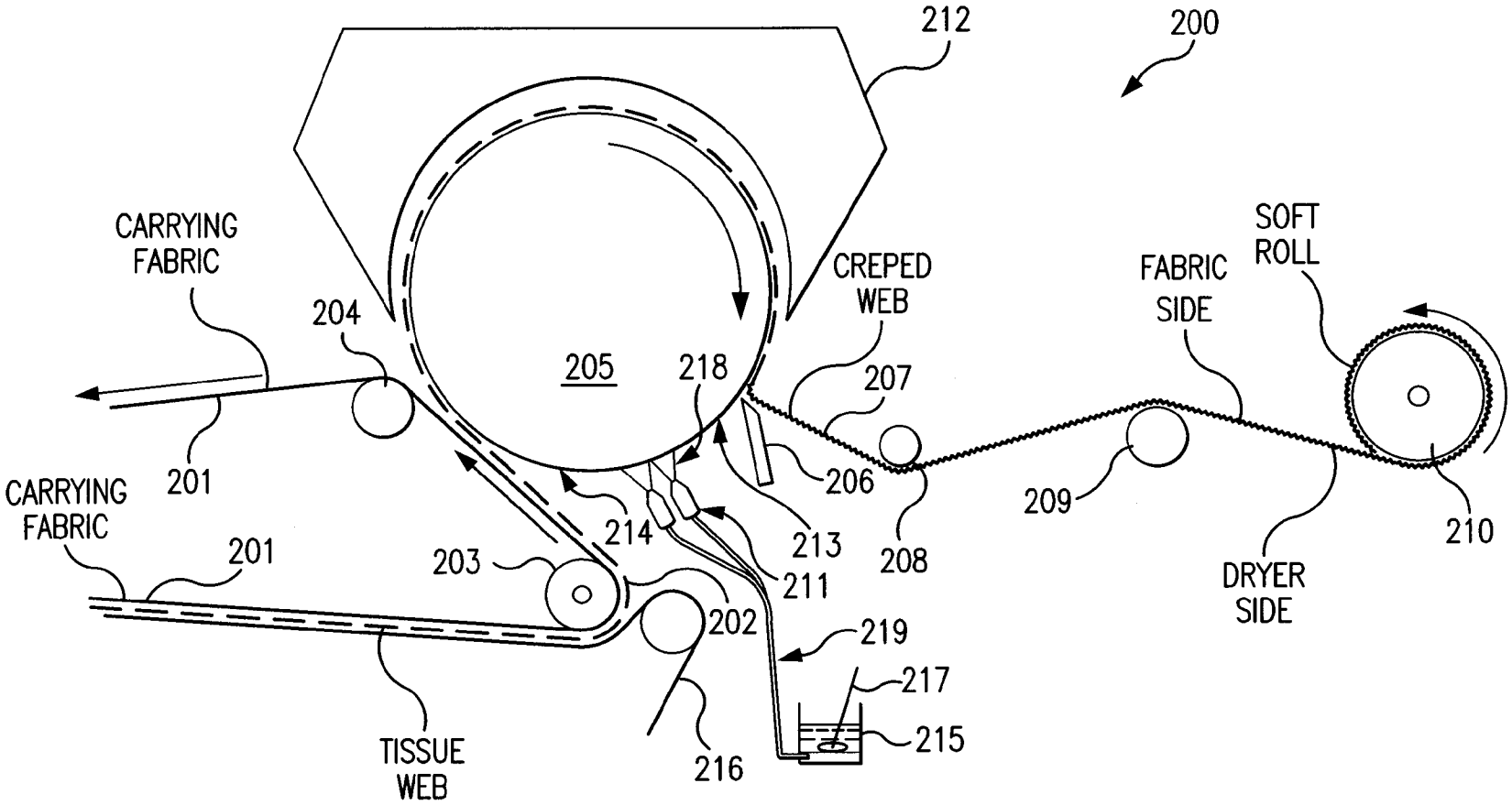
FIG. 2 is a schematic illustration of a creping system that can be used to perform a creping method according to the present invention.

Referring to FIG. 2, a system 200 is shown for creping tissue with applying of a creping adhesive composition 218 to a Yankee dryer 205 according to a method of the present invention. The transfer and impression fabric designated reference numeral 201 can carry the formed, dewatered and partially dried web 202 around turning roll 203 to the nip between press roll 204 and Yankee dryer 205. A supplemental lower carrier designated at 216 may also be employed to carry the web in sandwich fashion, which may be particularly useful under conditions of higher web dryness. The fabric, web, and dryer move in the directions indicated by the arrows. The entry of the web into the dryer is well around the roll from creping blade 206, which, as is schematically indicated, crepes the traveling web from the dryer as indicated at 207. The creped web 207 exiting from the dryer passes over guide and tension rollers 208, 209 and is wound into a soft creped tissue roll 210. To adhere a partially dried and dewatered paper web 202 (at, for example, 10-90 wt. % fiber consistency) entering the dryer to the surface of the dryer, a spray boom 211 can be used to apply a creping adhesive composition 218 to the dryer surface 213 which is exposed after de-contacting the creped tissue web 207 from the dryer 205 to provide an adhesive dryer surface 214 ahead of the nip between the press roll 204 and Yankee 205. The spray boom 211 can be a single spray boom or multi-spray boom, such as a dual-spray boom as illustrated. The spray boom can include an overspray collection container (not shown). The spray boom 211 is fluidly connected 219 to a mixing pot 215 for feeding creping adhesive composition from the mixing pot after pH modification. The mixing pot 215 can be equipped with an agitator 217. The mixing pot can be fed the adhesive base formulation components of the creping adhesive composition and water via feed supply lines (not shown). To reduce potential local alkaline shock to the adhesive base formulation, the pH modifier can be, for example, diluted with the feed water in advance of being supplied to the mixing pot 215, added with vigorous agitation of the mix pot contents, or both. The adhesive base formulation components including the crosslinkable polymer and pH modifier can be introduced into the mixing pot 215 in any convenient manner. The resulting pH modified creping adhesive composition can be pumped or otherwise fed under pressure to the nozzle sprayer(s) of the spray boom 211. To promote drying of the web on the dryer, the Yankee 205 can be internally steam heated by conventional or other suitable arrangements (not shown), externally heated using a hood 212, or using both. This sprayed composition 218 optionally may be applied to the traveling web 202 directly, but is preferably directly sprayed onto the dryer surface 213, such as to limit the pickup of adhesive by the web and to limit the penetration of adhesive through the web to the carrying fabric. Sprayer systems and arrangements which can be adapted and used in methods of the present invention include, for example, those described in U.S. Pat. No. 6,465,047 B1, which is incorporated herein by reference in its entirety.

As an option, the spray can be aqueous and suitably has a total solids content of from about 0.5% by weight to as much as about 80% by weight total solids, or from about 0.75% by weight to about 20% by weight total solids, or from about 1% by weight to about 15% by weight total solids, although any suitable solids content can be used. For roll coating of the creping adhesive composition onto the dryer surface, or knife coating, higher total solids contents may be employed, such as, for example, from about 1% by weight to about 70% by weight, for example, from about 3% by weight to about 50% by weight.

The creping adhesive composition can be applied to the dryer surface at a rate, relative to the rate of dryer surface rotation, which provides an adequate amount of adhesive to hold the web during drying yet release the dried web upon completion of drying. Conventional adhesive coverage rates and weights can be used as are known to those skilled in the art. The creping adhesive composition can be continuously applied to the rotating dryer so that an adequate amount of adhesive is always on the dryer surface.

Exemplary application rates of the creping adhesive composition on the dryer surface can provide an application rate of the crosslinkable polymer component thereof in a range, for example, of from about 0.5 $mg/m^2$ to about 100 $mg/m^2$, or from about 1 $mg/m^2$ to about 75 $mg/m^2$, or from about 1.5 $mg/m^2$ to about 50 $mg/m^2$, or from about 2 $mg/m^2$ to about 30 $mg/m^2$, or from about 2.5 $mg/m^2$ to about 25 $mg/m^2$, or from about 3 $mg/m^2$ to about 20 $mg/m^2$, or from about 3.5 $mg/m^2$ to about 10 $mg/m^2$, or other rates, based on the solids weight of the crosslinkable polymer and coated dryer surface area. If used as a pH modifier added to the adhesive base formulation, a polyalkali metal pyrophosphate (e.g., TKPP or TSPP) can be applied as part of a resulting creping adhesive composition to a dryer surface of a rotating cylindrical dryer at a rate, for example, of from about 0.5 $mg/m^2$ or more, or from about 0.5 $mg/m^2$ to about 5.5 $mg/m^2$, or from about 0.75 $mg/m^2$ to about 4.5 $mg/m^2$, or from about 1.0 $mg/m^2$ to about 3 $mg/m^2$, or from about 1.2 $mg/m^2$ to about 2.75 $mg/m^2$, on a dry solid basis, or other rates. If used in combination with the crosslinkable polymer in the creping adhesive composition, a release aid, can be used in an application rate in a range, for example, of from about 1 $mg/m^2$ to as much as 150 $mg/m^2$, or from about 3 $mg/m^2$ to about 100 $mg/m^2$, or from about 5 $mg/m^2$ to about 50 mg/m$^2$, or from about 7 mg/m$^2$ to about 30 mg/m$^2$, or from about 10 mg/m$^2$ to about 25 mg/m$^2$, or from about 12.5 mg/m$^2$ to about 20 mg/m$^2$, or from about 14 mg/m$^2$ to about 18 mg/m$^2$, or other rates, based on the solids weight of the release aid and coated dryer surface area.

Other creping systems, methods, and adhesives are described in the following U.S. Patents which are incorporated herein in their entireties by reference: U.S. Pat. Nos. 3,640,841; 4,304,625; 4,440,898; 4,788,243; 4,994,146; 5,025,046; 5,187,219; 5,326,434; 5,246,544; 5,370,773; 5,487,813; 5,490,903; 5,633,309; 5,660,687; 5,846,380; 4,300,981; 4,063,995; 4,501,640; 4,528,316; 4,886,579; 5,179,150; 5,234,547; 5,374,334; 5,382,323; 5,468,796; 5,902,862; 5,942,085; 5,944,954; 3,879,257; 4,684,439; 3,926,716; 4,883,564; 5,437,766. The adhesives used according to the present invention can provide enhanced runnability and reduced chatter. Creping with the pH modified adhesives according to the methods of the present invention can enhance operational runnability because the adhesives retain their adhesion over wide moisture and temperature ranges, and can be rewettable. As shown in the examples, for example, the methods of the present invention are versatile enough to be used on smaller diameter Yankee dryers operated at high running speeds. For example, the methods can be applied to a Yankee dryer which has a diameter of less than about 15 feet, or less than about 12 feet, or less than about 10 feet, or from about 5 feet to about 15 feet, or from about 7.5 to 12 feet, or other diameters, with the Yankee dryer can be run at a speed of from about 2000 feet/minute to about 3500 feet/minute, or from about 2200 feet/minute to about 3200 feet/minute, or from about 2500 feet/minute to about 3000 feet/minute, or other running speeds. As an option, because of the chemical setting of the creping adhesive composition provided by methods of the present invention, the temperature of dryer surface can be kept at lower values or reduced, for example, such as to from about 25° C. to about 75° C., or to from about 35° C. to about 60° C., or other values. Creped products produced using the present methods and modified adhesives of the present invention, results in superior creped tissue and towel products when compared to products made by systems and methods that use conventional adhesives. The rewettability which adhesives of the present invention can have, minimizes irreversible felt filling, minimizes deposit formation, and minimizes clean-up time and efforts. The methods of using the pH modified adhesives according to the present invention can enhance the creping performance in any type of tissue and towelling process, including Yankee dryer processes, through-air dryer processes, and wet crepe tissue machine processes.

The present invention includes the following aspects/embodiments/features in any order and/or in any combination:

1. The present invention relates to a process for manufacturing a creped fiber web, comprising:

providing a rotating cylindrical dryer including a dryer surface;

providing a coating applicator fluidly connected to a supply or feed;

providing an adhesive base formulation in the supply or feed comprising a crosslinkable polymer, wherein the adhesive base formulation has a first pH value, wherein the first pH value is from about 3.5 to about 8.5;

adding a pH modifier to said adhesive base formulation to provide a creping adhesive composition having a second pH value, wherein the second pH value is at least about 0.5 pH units greater than the first pH value;

applying said creping adhesive composition to the dryer surface with the coating applicator to provide an adhesive dryer surface;

conveying a fibrous web into contact with the adhesive dryer surface;

drying the fiber web on said adhesive dryer surface to form a dried fiber web; and creping the dried fiber web from said adhesive dryer surface.

2. The process of any preceding or following embodiment/feature/aspect, wherein first pH value is an acidic pH.

3. The process of any preceding or following embodiment/feature/aspect, wherein the second pH value is a neutral or basic pH 4. The process of any preceding or following embodiment/feature/aspect, wherein the second pH is a pH value of up to about 9.0.

5. The process of any preceding or following embodiment/feature/aspect, wherein the second pH value is a pH value of from about 7 to about 8.5.

6. The process of any preceding or following embodiment/feature/aspect, wherein the adding of the pH modifier to said adhesive base formulation is effective for chemically setting at least a portion of the crosslinkable polymer to form a crosslinked polymer before the creping adhesive composition contacts the dryer surface.

7. The process of any preceding or following embodiment/feature/aspect, wherein the rotating cylindrical dryer is a Yankee drum.

8. The process of any preceding or following embodiment/feature/aspect, wherein the coating applicator comprises at least one sprayer for spraying the creping adhesive composition onto the dryer surface.

9. The process of any preceding or following embodiment/feature/aspect, wherein said coating applicator comprises a spray boom.

10. The process of any preceding or following embodiment/feature/aspect, wherein pH modifier is an inorganic alkali material, an inorganic alkaline earth material, an organic base, or any combinations thereof.

11. The process of any preceding or following embodiment/feature/aspect, wherein the pH modifier is an alkali metal hydroxide, an alkali metal oxide, an alkali metal phosphate, an alkali metal carbonate, an alkali metal bicarbonate, an alkaline earth hydroxide, an alkaline earth oxide, an alkaline earth phosphate, an alkaline earth carbonate, ammonium zirconium carbonate, organotitanate, organozirconate, ammonium hydroxide, ammonium carbonate, ammonium bicarbonate, alkali metal silicate, urea, substituted urea, a cyanate, an alkylamine, an alkanolamine, a quaternary ammonium salt, a polyalkali metal pyrophosphate, salt of a weak acid and a strong base, an alkaline buffering solution, or any combinations thereof.

12. The process of any preceding or following embodiment/feature/aspect, wherein pH modifier is an alkali hydroxide, an alkaline earth hydroxide, a metal carbonate, an ammonium zirconium carbonate, an organotitanate, an organozirconate, a polyalkali metal pyrophosphate, or any combinations thereof.

13. The process of any preceding or following embodiment/feature/aspect, wherein said adding of said pH modifier comprises introducing said pH modifier as a premixture with water to a mixing vessel, to make-up water, to a feed going to a boom, or a return to a mixing vessel, or any combination thereof.

14. The process of any preceding or following embodiment/feature/aspect, further comprising introducing a release modifier to the adhesive base formulation.

15. The process of any preceding or following embodiment/feature/aspect, wherein said crosslinkable polymer comprises a crosslinkable cationic water-soluble polymer.

16. The process of any preceding or following embodiment/feature/aspect, wherein the rotating cylindrical dryer has a diameter of less than about 15 feet and is run at a speed of from about 2000 feet/minute to about 3500 feet/minute.

17. The process of any preceding or following embodiment/feature/aspect, wherein the adhesive dryer surface is a cylindrical surface heated to a temperature of from about 90° C. to about 110° C.

18. The process of any preceding or following embodiment/feature/aspect, wherein crosslinkable polymer is in an aqueous medium having an acidic pH.

19. The process of any preceding or following embodiment/feature/aspect, wherein said adhesive base formulation further comprises a second cationic water-soluble polymer different from the crosslinkable polymer.

20. The process of any preceding or following embodiment/feature/aspect, wherein said adhesive base formulation further comprises a release modifier.

21. The process of any preceding or following embodiment/feature/aspect, wherein said creping adhesive composition comprises about 1 to 3% by weight said crosslinked polymer, about 1 to 3% by weight release modifier, from about 0 to 1% by weight phosphate donor, and from about 95% by weight to about 99% by weight water from all sources, by weight of said composition.

22. The process of any preceding or following embodiment/feature/aspect, further comprising drying said fiber web to a consistency of at least about 90% by weight before creping said fiber web from said adhesive dryer surface.

23. A process of making creped fiber web, comprising:

increasing the pH of an adhesive base formulation that is to be used on a dryer surface, wherein said adhesive base formulation comprises at least one crosslinkable polymer, wherein the adhesive base formulation has a first pH value that is from about 4.5 to about 8.5, and said increasing of the pH is by at least about 0.5 pH units greater than the first pH value so as to form a creping adhesive composition.

24. The process of any preceding or following embodiment/feature/aspect, further comprising:

applying said creping adhesive composition to the dryer surface.

25. The process of any preceding or following embodiment/feature/aspect, further comprising:

applying said creping adhesive composition to the dryer surface with a spray boom and said increasing of the pH occurs in a mixing pot, in make-up water, or a feed line to said spray boom, prior to said applying with the spray boom.

26. The process of any preceding or following embodiment/feature/aspect, further comprising:

conveying a fibrous web into contact with the dryer surface having said creping adhesive composition;

drying the fiber web to form a dried fiber web; and creping the dried fiber web.

27. A method to increase the setting time of a creping adhesive that is applied on a dryer surface, comprising increasing the pH of an adhesive base formulation that is to be used on the dryer surface, wherein said adhesive base formulation comprises at least one crosslinkable polymer, wherein the adhesive base formulation has a first pH value that is from about 4.5 to about 8.5, and said increasing of the pH is by at least about 0.5 pH units greater than the first pH value so as to form a creping adhesive composition.

28. A creped fiber product made from the process of any preceding or following embodiment/feature/aspect.

29. The process of any preceding or following embodiment/feature/aspect, wherein the first pH value is from 4.5 to 6 and the second pH value is from 6.1 to 8.5.

30. The process of any preceding or following embodiment/feature/aspect, wherein the firs pH value is increased by at least 2 pH units.

The present invention can include any combination of these various features or embodiments above and/or below as set forth in sentences and/or paragraphs. Any combination of disclosed features herein is considered part of the present invention and no limitation is intended with respect to combinable features.

The present invention will be further clarified by the following examples, which are intended to be exemplary of the present invention.

EXAMPLES

The following Examples described and results, such as shown in FIGS. 3 and 4, indicate the creping performance of a method using a pH modified adhesive formulation used according to the present invention.

Example 1

In this Example, an adhesive base formulation was prepared which contained a polymer containing composition of CREPETROL® 5318, a commercial PAE creping adhesive (Hercules Incorporated), and a release agent, BUSPERSE® 2097 (Buckman Laboratories International Inc.), in an aqueous dispersion. An eight foot diameter Yankee dryer was used for creping the towel fiber sheet, which dryer had a suction press roll. Pressure on nozzle was approximately 108-110 psi, and running speed was adjusted from about 2600 to about 2900 feet/minute (FPM). This machine was a semiwet crepe design with a flat former. The fiber sheet had a moisture content of approximately 60-70 wt. % as transferred to the Yankee dryer, and moisture content of approximately 15-20 wt. % when the creped product was removed from the dryer. The Yankee dryer and reel speeds, in feet per minute (FPM) units, pump setting, and the dryer hood temperature in degrees Fahrenheit (° F.), used in this study are indicated in the table in FIG. 3. The adhesive was used at a coating rate of about 3.5 mg/m$^2$ and the release agent was used at about 10.6 mg/m$^2$. The initial spray boom shower pH was 6.0. 10 wt. % NaOH solution was added to a recirculation pot of the spray system to raise the pH of the adhesive formulation to about 8.0. At pH 6.0, the machine speed was 2600 feet/minute (FPM) and after a couple of hours at 8.0 pH the speed was successfully increased to 2900 FPM without coating streaking or chatter. The dwell on this eight foot Yankee dryer was 39.7 milliseconds. At approximately 2900 FPM, some wild edges (front) occurred. Addition of PROSOFT® TC9700 (Hercules Incorporated), was added which prevented wild edges at the indicated higher speeds. At lower speeds, the one adhesive was fully satisfactory. Visual observations by experienced technicians or operators were used to evaluate the quality of the creping performance, such as in terms of observing for coating edge buildup, streaking, and chatter. The running speeds were able to be increased from about 2600 FPM to 2900 FPM without loss of creping performance by only changing the pH of the boom shower. It was shown that the drying rates (reaction) for the creping adhesive composition can be sped up without adverse streaking or chatter by raising the pH of the creping adhesive composition at least 0.5 pH units.

Example 2

A separate study was run on a 10 foot diameter Yankee dryer used for creping napkin grade paper sheets, which has a 22.5 millisecond dwell. 10 wt. % NaOH solution was fed into a mix pot. About 10 cc per minute of the caustic was added. A similar formulation of adhesive and release agent as used in Example 1 was also used in this example. The fiber sheet had a moisture content of approximately 60-70 wt. % as transferred to the Yankee dryer, and moisture content of approximately 8-10 wt. % when the creped product was removed from the dryer. The Yankee dryer and reel speeds, in feet per minute (FPM) units, pump setting, and a Yankee temperature of 56° F., used in this study are indicated in the table in FIG. 4. The initial pH was 5.9 and the caustic was added to increase the pH to about 7.6. The amount of CREPETROL® 5318 adhesive coating rate was able to be reduced from 3.1 mg/m$^2$ to 2.4 mg/m$^2$ (about 20% reduction) without streaking or chatter while leaving the release agent (BUSPERSE® 2097) amount unchanged at 15.7 mg/m$^2$. Visual observations by experienced technicians or operators were used to evaluate the quality of the creping performance, such as in terms of observing for coating edge buildup, streaking, and chatter. Even at the reduced add-on rates for the pH modified adhesive, a constant bulk was able to be maintained and an excellent Yankee coating was provided without adverse streaking or chatter on this dry crepe machine. Blade wear was normal after 8 hours of operation.

Example 3

A separate study was run on a 18-foot diameter Yankee dryer which handled 12# towel grade sheets at 12 wt. % to 14 wt. % moisture. 10 wt. % NaOH solution was fed directly into the fresh water as it made up level in a mix pot. About 15-35 cc per minute of the caustic was added. In this Example, an adhesive base formulation was prepared which contained a polymer containing composition of BUBOND® 2624, a commercial modified polyamine-type creping adhesive (Buckman Laboratories International Inc.), and a release agent, BUSPERSE® 2097, in an aqueous dispersion. The fiber sheet had a moisture content of approximately 65-70 wt. % as transferred to the Yankee dryer, and moisture content of approximately 5-10 wt. % when the creped product was removed from the dryer. The Yankee dryer speed was 4500-5500 FPM and the reel speed was 4000-4500 FPM. The Yankee temperature was 180-210° F. and the pressure was 90-110 psi. The initial pH was 5-6.5 and the caustic was added to increase the pH to about 7.8-8.8. The BUBOND® 2624 adhesive coating rate used was about 2.0 to 6.0 mg/m$^2$. The BUSPERSE® 2097 coating rate was about 8-16 mg/m$^2$. Visual observations by experienced technicians or operators were used to evaluate the quality of the creping performance, such as in terms of observing for coating edge buildup, streaking, and chatter. Thickened film development and much more rapid cure (setting) rates were observed without adverse streaking or chatter.

Example 4

A separate study was run on a 10-foot diameter Yankee dryer which handled 8# lightweight grade sheets at 4-10 wt. % moisture. 10 wt. % NaOH solution was fed directly into the fresh water as it made up level in a mix pot. About 5-20 cc per minute of the caustic was added. In this Example, an adhesive base formulation was prepared which contained a polymer containing composition of CREPETROL® 5318 and a release agent, BUSPERSE® 2097, in an aqueous dispersion. The fiber sheet had a moisture content of approximately 65-75 wt. % as transferred to the Yankee dryer, and moisture content of approximately 6-10 wt. % when the creped product was removed from the dryer. The Yankee dryer speed was 3000-4000 FPM and the reel speed was 2500-3200 FPM. The Yankee temperature was 180-210° F. and the pressure was 45 psi. The initial pH was 5.0-6.0 and the caustic was added to increase the pH to about 7.5-8.5, at which the line was run for 4-5 hours. The BUSPERSE® 2097 coating rate was about 7-14 mg/m$^2$. The coating rate of CREPETROL® 5318 was able to be reduced about 15% from about 3.0 mg/m$^2$ to about 2.4 mg/m$^2$ while maintaining visibly better coating buildup and no adverse streaking or chatter.

Example 5

A separate study was run on a Yankee dryer which handled 100% recycled fiber (RF) towel grade sheets. In this Example, an adhesive base formulation was prepared which contained a polymer containing composition of BUBOND® 2624 as a source of crosslinkable polymer, and BUSPERSE® 2906 for coating build-up control, in an aqueous dispersion. Cleaning and creping blades were loaded on the Yankee drum at 40 pounds per linear inch (PLI). The fiber sheet moisture contents and other Yankee dryer equipment and operating conditions were substantially similar to those described in Example 3. BUBOND® 2436, as a source of tetrapotassium pyrophosphate (60% TKPP in water), was added to the adhesive base formulation at the spray boom before coating the resulting creping adhesive composition on the drum. The dosage of BUBOND® 2436 add-on was varied between the amounts of 0.4 mg/m$^2$, 2.0 mg/m$^2$, 4.3 mg/m$^2$, and 10 mg/m$^2$, with results observed for each dosage. The initial pH of the adhesive base formulation before addition of BUBOND® 2436 was 3.5. The BUBOND® 2624 adhesive coating rate used was about 8 mg/m$^2$, and the BUSPERSE® 2906 coating rate was about 2.5 mg/m$^2$. Visual observations by experienced technicians were used to evaluate the quality of the creping performance, such as in terms of observing for coating edge buildup, streaking, and corrugation. At a dosage of 0.4 mg/m$^2$ BUBOND® 2436, the spray boom adhesive pH was 3.5 and half of the roll did not pass quality requirement for corrugation. At a dosage of 2.0 mg/m$^2$ BUBOND® 2436, the spray boom adhesive pH was 5.5 and corrugation became acceptable. At a dosage of 4.3 mg/m$^2$ BUBOND® 2436, the spray boom adhesive pH was 7.2 and at a dosage of 10.0 mg/m$^2$ BUBOND® 2436, the spray boom adhesive pH was about 7 and passed quality requirements for creping performance.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A process for manufacturing a creped fiber web, comprising:

providing a rotating cylindrical dryer including a dryer surface;

providing a coating applicator fluidly connected to a supply or feed;

providing an adhesive base formulation in the supply or feed comprising a crosslinkable polymer, in an aqueous medium having an acidic pH, wherein the adhesive base formulation has a first pH value, wherein the first pH value is from about 3.5 to about 8.5;

adding a pH modifier to said adhesive base formulation to provide a creping adhesive composition having a second pH value, wherein the second pH value is at least about 0.5 pH units greater than the first pH value, wherein said adding of said pH modifier comprises introducing said pH modifier as a premixture with water to a mixing vessel, to make-up water, to a feed going to a boom, or a return to a mixing vessel, or any combination thereof;

applying said creping adhesive composition to the dryer surface with the coating applicator to provide an adhesive dryer surface;

conveying a fibrous web into contact with the adhesive dryer surface;

drying the fiber web on said adhesive dryer surface to form a dried fiber web; and creping the dried fiber web from said adhesive dryer surface, wherein the adding of the pH modifier to said adhesive base formulation is effective for chemically setting at least a portion of the crosslinkable polymer to form a crosslinked polymer before the creping adhesive composition contacts the dryer surface.

2. The process of claim 1, wherein first pH value is an acidic pH.

3. The process of claim 1, wherein the second pH value a neutral or basic pH.

4. The process of claim 1, wherein the second pH is a pH value of up to about 9.0.

5. The process of claim 1, wherein the second pH value is a pH value of from about 7.0 to about 8.5.

6. The process of claim 1, wherein the rotating cylindrical dryer is a Yankee drum.

7. The process of claim 1, wherein the coating applicator comprises at least one sprayer for spraying the creping adhesive composition onto the dryer surface.

8. The process of claim 1, wherein said coating applicator comprises a spray boom.

9. The process of claim 1, wherein pH modifier is an inorganic alkali material, an inorganic alkaline earth material, an organic base, or any combinations thereof.

10. The process of claim 1, wherein the pH modifier is an alkali metal hydroxide, an alkali metal oxide, an alkali metal phosphate, an alkali metal carbonate, an alkali metal bicarbonate, an alkaline earth hydroxide, an alkaline earth oxide, an alkaline earth phosphate, an alkaline earth carbonate, ammonium zirconium carbonate, organotitanate, organozirconate, ammonium hydroxide, ammonium carbonate, ammonium bicarbonate, alkali metal silicate, urea, substituted urea, a cyanate, an alkylamine, an alkanolamine, a quaternary ammonium salt, a polyalkali metal pyrophosphate, salt of a weak acid and a strong base, an alkaline buffering solution, or any combinations thereof.

11. The process of claim 1, wherein pH modifier is an alkali hydroxide, an alkaline earth hydroxide, a metal carbonate, an ammonium zirconium carbonate, an organotitanate, an organozirconate, a polyalkali metal pyrophosphate, or any combinations thereof.

12. The process of claim 1, further comprising introducing a release modifier to the adhesive base formulation.

13. The process of claim 1, wherein said crosslinkable polymer comprises a crosslinkable cationic water-soluble polymer.

14. The process of claim 1, wherein the rotating cylindrical dryer has a diameter of less than about 15 feet and is run at a speed of from about 2000 feet/minute to about 3500 feet/minute.

15. The process of claim 1, wherein the adhesive dryer surface is a cylindrical surface heated to a temperature of from about 90° C. to about 110° C.

16. The process of claim 1, wherein said adhesive base formulation further comprises a second cationic water-soluble polymer different from the crosslinkable polymer.

17. The process of claim 1, wherein said adhesive base formulation further comprises a release modifier.

18. The process of claim 1, wherein said creping adhesive composition comprises about 1 to 3% by weight said crosslinked polymer, about 1 to 3% by weight release modifier, from about 0 to 1% by weight phosphate donor, and from about 95% by weight to about 99% by weight water from all sources, by weight of said composition.

19. The process of claim 1, further comprising drying said fiber web to a consistency of at least about 90% by weight before creping said fiber web from said adhesive dryer surface.

20. The process of claim 1, wherein the first pH value is from 4.5 to 6 and the second pH value is from 6.1 to 8.5.

21. The process of claim 1, wherein the first pH value is increased by at least 2 pH units.

22. A process of making creped fiber web, comprising:

increasing the pH of an adhesive base formulation that is to be used on a dryer surface, wherein said adhesive base formulation comprises at least one crosslinkable polymer, wherein the adhesive base formulation has a first pH value that is from about 4.5 to about 8.5, and said increasing of the pH is by at least about 0.5 pH units greater than the first pH value so as to form a creping adhesive composition, and applying said adhesive base formulation to the dryer surface with a spray boom and said increasing of the pH occurs in a mixing pot, make-up water, or a feed line to said spray boom prior to said applying with the spray boom;

conveying a fibrous web into contact with the dryer surface having said adhesive base formulation;

drying the fiber web to form a dried fiber web;

creping the dried fiber web; and wherein the adding of the pH modifier to said adhesive base formulation is effective for chemically setting at least a portion of the crosslinkable polymer to form a crosslinked polymer before the adhesive base formulation contacts the dryer surface.

* * * * *